US005636396A

United States Patent [19]

Workman et al.

[11] Patent Number: 5,636,396

[45] Date of Patent: Jun. 10, 1997

[54] INNER SPRING BORDER FIRMNESS ADJUSTER

[75] Inventors: Joe C. Workman; Steven E. Ogle; Thomas J. Wells, all of Carthage, Mo.

[73] Assignee: L&P Property Management Company, Chicago, Ill.

[21] Appl. No.: 539,195

[22] Filed: Oct. 4, 1995

[51] Int. Cl.[6] ..... A47C 23/04; A47C 23/047

[52] U.S. Cl. ..... 5/717; 5/260

[58] Field of Search ..... 5/260, 261, 474, 5/475, 476; 267/80, 82, 91

[56] References Cited

U.S. PATENT DOCUMENTS

| | | | |
|---|---|---|---|
| 2,826,769 | 3/1958 | Drews . | |
| 3,022,521 | 2/1962 | Martin | 5/474 |
| 3,089,154 | 5/1963 | Boyles . | |
| 3,121,882 | 2/1964 | Drews | 5/261 |
| 3,121,883 | 2/1964 | Kline | 5/261 |
| 3,618,146 | 11/1971 | Ferdinand . | |
| 3,822,426 | 7/1974 | Mistarz . | |
| 3,872,525 | 3/1975 | Lea et al. | 5/348 R |
| 3,982,290 | 9/1976 | Ward | 5/475 |
| 5,062,172 | 11/1991 | Stewart | 5/260 |
| 5,105,488 | 4/1992 | Hutchinson et al. . | |
| 5,113,539 | 5/1992 | Strell . | |
| 5,133,116 | 7/1992 | Wagner et al. | 5/474 |
| 5,239,715 | 8/1993 | Wagner | 5/475 |
| 5,304,271 | 4/1994 | Gusakov | 5/449 |

*Primary Examiner*—Rodney M. Lindsey
*Assistant Examiner*—Robert G. Santos
*Attorney, Agent, or Firm*—Wood, Herron & Evans, L.L.P.

[57] ABSTRACT

An inner spring core comprising a plurality of coil springs arranged in rows and columns having an improved border firmness adjuster around the periphery of the core. The improved border firmness adjuster comprises one of more inflatable pneumatic members positioned inwardly of the outer edges of the outermost coil springs in a space between two adjacent convolutions of each of the outermost coil springs. The pneumatic member or members is capable of variably adjusting the firmness of at least one edge of the mattress.

11 Claims, 3 Drawing Sheets

INNER SPRING BORDER FIRMNESS ADJUSTER

BACKGROUND OF THE INVENTION

This invention relates to inner spring mattresses and more particularly, to a border firmness adjuster for adjusting the firmness of the border or peripheral portion of a mattress.

DESCRIPTION OF PRIOR ART

A traditional mattress has an inner spring core comprising a plurality of identically configured coil springs, the core being covered with a mattress pad and an upholstered covering surrounding the core and mattress pad. Such a traditional mattress typically has one degree of firmness throughout because the inner spring core of the mattress is uniform throughout.

There also exist mattresses having differing degrees of firmness in different portions of the mattress. For example, there are mattresses which have increased firmness in the middle or lumbar portion of the mattress as disclosed for example in U.S. Pat. No. 5,113,539 and U.S. Pat. No. 5,105,488.

There also exist mattresses which have increased firmness about the edge portions of a mattress primarily to prevent collapse of the side edge of the mattress when a person sits on the edge and to prevent loss of resiliency of the edge of the mattress as a result of persons repeatedly getting on and off the bed by sitting or leaning on one edge of the mattress.

One method of firming up the outer periphery or edge of a mattress is disclosed in U.S. Pat. No. 5,133,116. According to the disclosure of this patent a rope is wrapped for several revolutions around the perimeter of the mattress and between adjacent convolutions of the outermost peripheral coil springs of the mattress.

Another method of reinforcing the edge of a mattress is disclosed in U.S. Pat. No. 3,089,154 which discloses conventional mattress padding 44 extending between adjacent convolutions of the outermost coil springs of the mattress.

According to U.S. Pat. No. 2,826,769 a piece of foam rubber extends around the mattress and is inserted into the interior portion of the outermost or peripheral coil springs to support or reinforce the edge or border of a mattress.

U.S. Pat. Nos. 3,618,146 and 3,822,426 both disclose pieces of resilient foam inserted between the convolutions of the outermost or peripheral coil springs in order to stabilize the border of an inner spring mattress. The pieces of resilient foam are held in place by the slant of the convolutions of the helical coils of the coil springs.

One limitation of all of these prior border stabilizers or edge reinforcements is that they are not adjustable. The user does not have control over the firmness of the peripheral portion of the mattress.

It has therefore been an objective of this invention to provide an inner spring mattress in which the firmness of the peripheral or border portion of the mattress may be adjusted or raised.

It has been another objective of this invention to provide a spring mattress with an adjustable edge support utilizing an inflatable pneumatic member located between the outermost coil springs and the cover of the mattress.

It has been another objective of this invention to stabilize one or more edges of a spring mattress core with inflatable pneumatic members located about the periphery of the mattress between adjacent convolutions of the outermost coil springs.

SUMMARY OF THE INVENTION

The mattress of the present invention which accomplishes these objectives comprises an inner spring core made up of a plurality of coil springs arranged in rows and columns and an improved border firmness adjuster comprising one or more inflatable pneumatic members located about the periphery of the core. The inner spring core has an outermost row of coil springs on each end of the mattress along the perimeter of the mattress and an outermost column of coil springs on each side of the mattress along the perimeter of the mattress. Each of the coil springs has an upper end turn in a top plane, a bottom end turn in a bottom plane and a middle portion comprising a plurality of helical convolutions extending between the end turns.

A border firmness adjuster comprising at least one inflatable elongate pneumatic member is located along the perimeter of the mattress between two adjacent convolutions of the outermost coil springs. The inflatable elongate pneumatic member is positioned inwardly of the outer edges of the outermost coil springs so that a fabric covering may cover the mattress without interfering with the inflatable pneumatic member. Each inflatable pneumatic member is inflated via a stem which extends beyond the side of the mattress through a hole in the fabric covering. The operator may vary the pressure inside the pneumatic member through the use of an air compressor or other suitable air source attached to the stem in order to adjust the firmness of the border of the mattress.

DESCRIPTION OF THE PREFERRED EMBODIMENT

Figure 1:
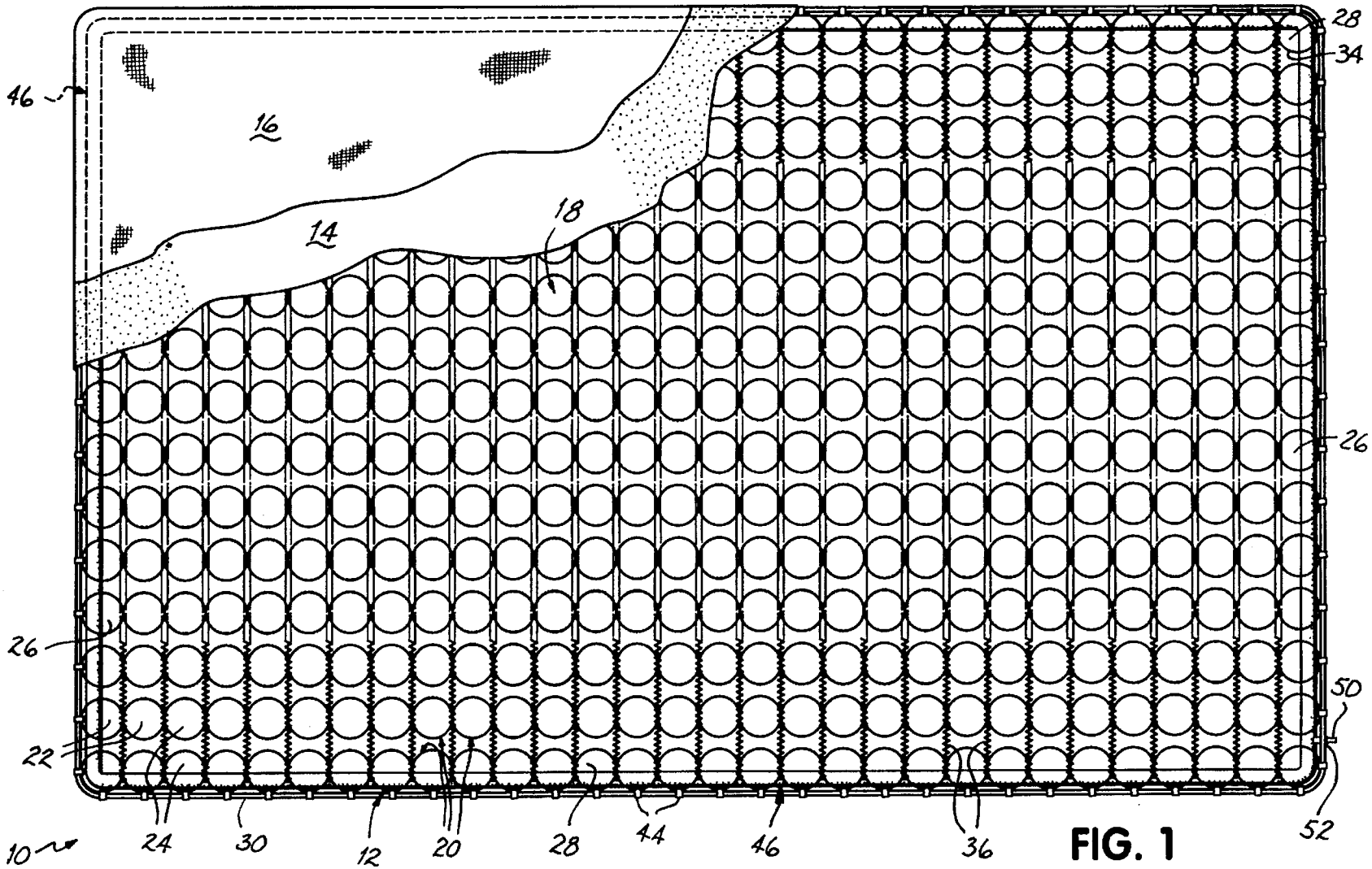
FIG. 1 is a top plan view of the preferred embodiment of the inner spring mattress of the present invention showing one elongate inflatable pneumatic member placed around the perimeter of the mattress.

Referring to the drawings and particularly to FIG. 1, there is illustrated a fully assembled inner spring mattress 10 of the present invention. This mattress comprises a conventional inner spring core 12, over which there is located a conventional mattress pad 14 and an upholstered fabric covering 16.

The inner spring core 12 comprises a matrix 18 of coil springs 20 arranged in rows 22 and columns 24.

The perimeter of the inner spring core 12 is made up of two opposed outermost rows 26 of coil springs 20, one row 26 on each end of the inner spring core 12 and two opposed outermost columns 28 of coil springs 20, one column 28 on each side of the inner spring core 12. These outermost rows and columns of springs are surrounded by and attached on their outer edges to border rods 30 and 32 located in the top and bottom planes of the mattress core 12. Each of the outer end rows 26 of coil springs 20 terminate in two corner coil springs 34. Each of the opposed outermost side columns 28 of coil springs 20 extends from a corner spring 34 of one outer end row 26 to a corner coil spring 34 of the other outer end row 26. All the rows 22 of coil springs 20 including the outermost rows 26 are connected to adjacent rows of coil springs 20 with helical lacing wires 36 which extend from one side of the mattress to the other side of the mattress.

The upper end turns 38 of the coil springs 20 are attached to the upper border wire 30 by a plurality of fasteners 44 which may be clips, or any other conventional fastener. Similarly, the lower end turns 42 of the coil springs 20 are likewise attached to the lower border wire 32 via clips or fasteners 44.

The mattress core 12 heretofore described is conventional. According to the practice of this invention, there is attached to the conventional mattress core 12 an inflatable pneumatic member 46 which surrounds the perimeter of the mattress core. The elongate inflatable pneumatic member 46 extends along the two outermost rows 26 of coil springs 20 and the two outermost columns 28 of coil springs 20 of the inner spring core 12. It resides inside the outer edge 48 of coil springs 20 of the two outermost columns 28 and the two outermost rows 20 of the inner spring core 12 (see FIG. 3). The inflatable pneumatic member 46 has a stem 50 which extends through a hole 52 in the upholstery fabric covering 16, allowing the operator to inflate the inflatable elongate pneumatic tube 46 to the desired pressure without disturbing the fabric covering 16 of the mattress 10.

Figure 2:
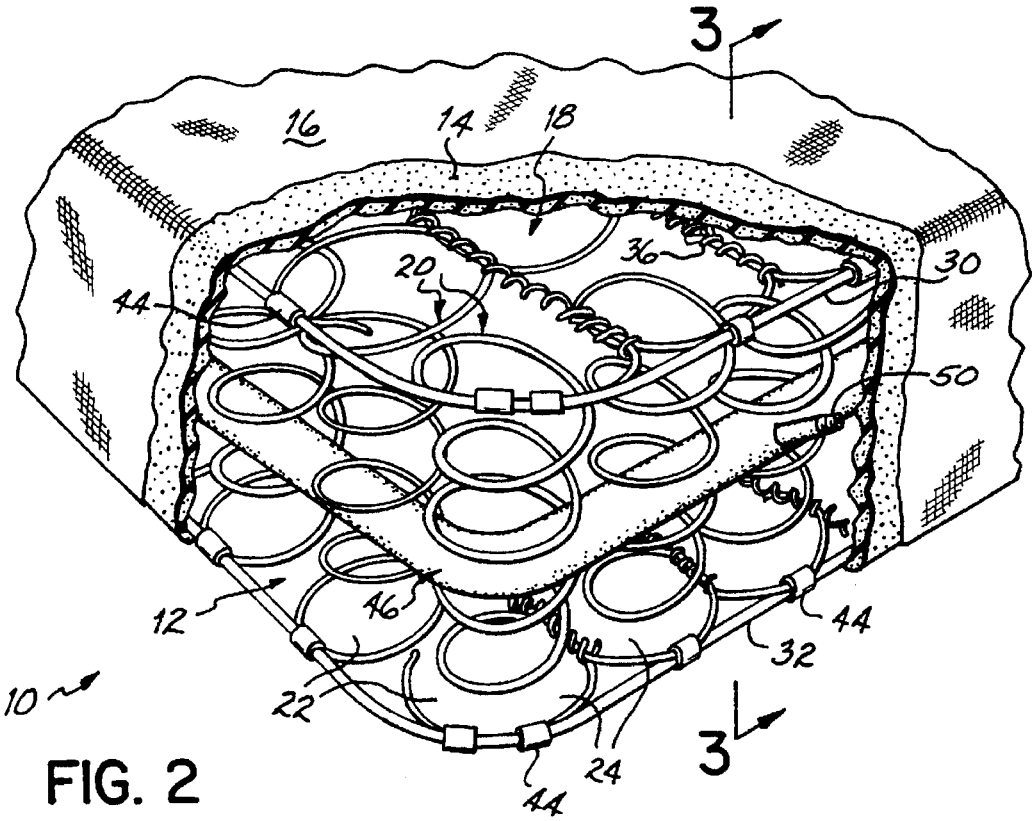
FIG. 2 is a perspective view of a corner of the inner spring mattress of FIG. 1 showing the inflatable pneumatic member resting between adjacent convolutions of the outermost coil springs.

As illustrated in FIG. 2, the preferred embodiment of the mattress of the present invention has the inflatable pneumatic member 46 wrapped around the entire periphery of the mattress core. The inflatable pneumatic member 46 is located between adjacent helical convolutions 54 of each of the coil springs 20 of the outermost rows 26 and outermost columns 28. Preferably the inflatable pneumatic member 46 is located between two adjacent helical convolutions 54 in the middle portion or center 56 of the coil springs 20 in order to enable the user of the mattress to flip the mattress over and use both sides of the mattress with the inflatable member always located medially between the two sides. However, the inflatable pneumatic member 46 could be inserted between convolutions closer to one side than the other and still practice the invention of this application.

In order to inflate or deflate the pneumatic member 46 and thereby increase or decrease the firmness of the edge or peripheral portion of the mattress, a user must inflate the pneumatic tube via a conventional valve stem 50 which protrudes through a hole 52 in the upholstered fabric covering 16. Depending upon the desired firmness of the peripheral portion of the mattress, the user may either inflate or deflate the elongate pneumatic member 46 via the stem 50 as appropriate.

Figure 3:
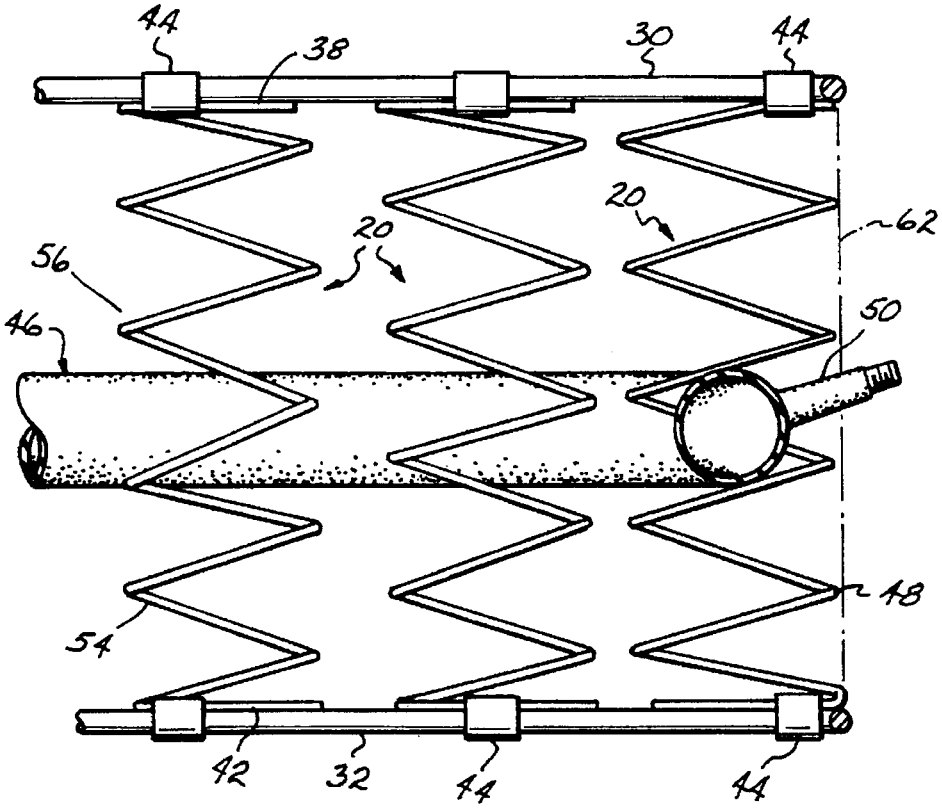
FIG. 3 is a cross-sectional view taken along line 3—3 of FIG. 2 showing the location of the pneumatic member with the stem protruding beyond the fabric covering.
Figure 4:
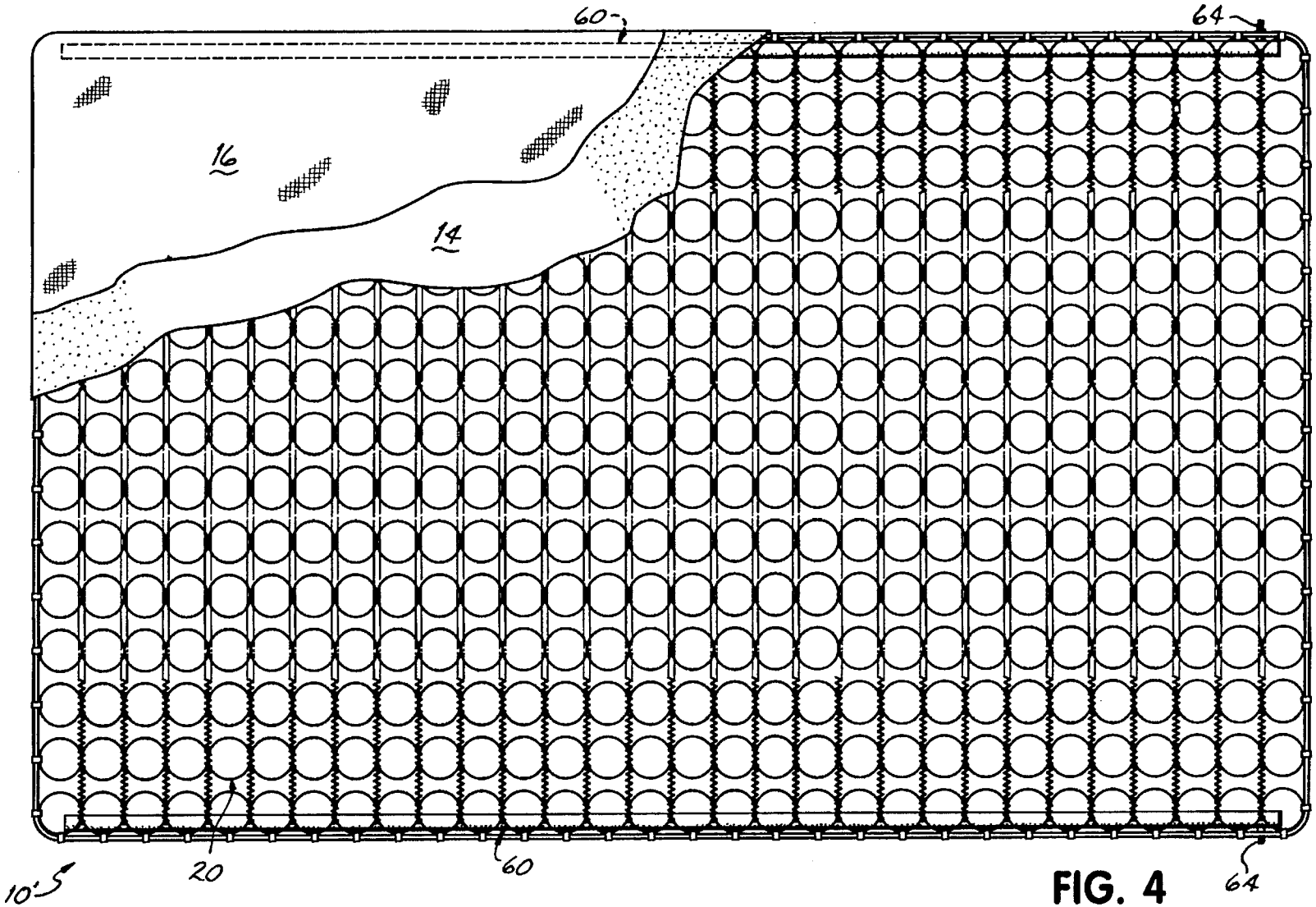
FIG. 4 shows an alternative embodiment of the present invention utilizing two separate inflatable pneumatic members, one along each side of the mattress.

FIG. 4 illustrates an alternative embodiment of the present invention utilizing two separate inflatable pneumatic members 60, one on each side of the mattress 10' rather than one continuous inflatable pneumatic member 46 wrapped around the perimeter of the mattress, as in the preferred embodiment of the invention illustrated in FIGS. 1–3. These two inflatable pneumatic members 60 are placed along the outermost columns 28 of coil springs 20 in order to enable a user to individually adjust the firmness of the two sides of the mattress 10' without affecting the end portions of the mattress.

As with the preferred embodiment of the present invention, each inflatable pneumatic member 60 rests between two adjacent convolutions 54 of the central helical portion 56 of the coil springs 20 of the outermost columns 28 of the mattress 10'. The two inflatable pneumatic members 60 preferably do not extend beyond the peripheral surface 62 of the outermost coil springs, the peripheral surface 62 being covered with fabric 16 during assembly. Each of the inflatable pneumatic members 60 has its own valve stem 64 so as to enable the user to inflate one pneumatic member more than the other in order to increase the firmness of one side of the mattress relative to the other side of the mattress.

As will be obvious to those skilled in the art, the present invention is not limited to an inner spring mattress with two opposed pneumatic members on the sides of the mattress, but may incorporate only one pneumatic member along either side or end of the mattress.

Having described only two embodiments of our invention, other variations and changes will be apparent to those skilled in this art. Therefore, we do not intend to be limited except by the scope of the following claims:

We claim:

1. A mattress inner spring core comprising:

a plurality of coil springs arranged in rows and columns around the perimeter of a core; and a border firmness adjustor comprising at least one hollow air filled adjustably inflatable elongate pneumatic member containing substantially no solid material positioned inwardly of the outer edges of the outermost coil springs in a space between two adjacent convolutions of each of said outermost coil springs, said at least one pneumatic member being capable of variably adjusting the firmness of at least one edge of said mattress.

2. A mattress inner spring core having a plurality of coil springs arranged in at least two outer opposed end rows and at least two outer opposed side columns, and an adjustably inflatable pneumatic member comprising a hollow air filled tube containing substantially no solid material, said pneumatic member surrounding said core, said pneumatic member positioned along the outer side of the outermost rows and columns of coil springs, said pneumatic member extending inwardly from the outer edges of said outermost coil springs between two adjacent convolutions of each of said coil springs, said pneumatic member being capable of variably adjusting the firmness of at least one edge of said mattress by a change in air pressure inside said pneumatic member.

3. A mattress inner spring core having a plurality of border coil springs arranged in two opposed end rows and two opposed side columns, each of said border coil springs having a planar upper portion in a top plane, a planar lower portion in a bottom plane and a middle portion therebetween; an elongated variably adjustable inflatable pneumatic member being located between adjacent convolutions of said middle portions of said border coil springs in order to enable the firmness of the edges of the mattress to be varied, said pneumatic member comprising a hollow air filled member containing substantially no solid material, said member being capable of being inflated and deflated.

4. A mattress inner spring core having four edges, said spring core comprising:

a plurality of coil springs arranged in a matrix, said matrix having a generally planar top surface, a generally planar bottom surface, and a generally rectangular peripheral edge surface, said edge surface being defined by two outer end rows of coil springs and two outer side columns of coil springs, with each of the coil springs in said outer end rows and side columns having a central axis, end turns of said coil springs being located in said planar top and bottom surfaces, and helical convolutions of said coil springs being located between said end turns, and an adjustably inflatable elongate pneumatic member surrounding said core, said pneumatic member being located between two adjacent convolutions of each of the coil springs of said end rows and said side columns, and being capable of variably adjusting the firmness of at least one edge of said mattress, said pneumatic member comprising a hollow air filled tube containing substantially no solid material, said tube being capable of being filled with air in order to vary the firmness of the edges of said spring core.

5. A mattress inner spring core comprising: a plurality of coil springs arranged in a matrix of rows and columns, each of said coil springs having a planar upper portion in a top plane and a planar lower portion in a bottom plane, the planar upper portion of adjacent rows of said coils springs being connected by helical lacing wires, said planar upper portions of said coil springs being surrounded by a first rectangular border wire in said top plane, said lower portions of said coil springs being surrounded by a second rectangular border wire in said bottom plane, the outermost coil springs of said matrix being fixedly attached to said border wire, and one air filled hollow elongated adjustably inflatable tubular pneumatic member containing substantially no solid material, said pneumatic member surrounding said matrix of coil springs, said member being located between adjacent convolutions of each of said outermost coil springs and being capable of variably adjusting the firmness of at least one edge of said mattress, said pneumatic member when deflated not exerting pressure on both of said adjacent convolutions.

6. An inner spring core having two side edges, said spring core comprising:

a plurality of coil springs arranged in a matrix, said matrix having two opposed outer end rows of coil springs and two opposed outer side columns of coil springs, each of said outer end rows terminating in two corner coil springs, each of said opposed outer side columns of coil springs extending from a corner coil spring of one row to a corner coil spring of the other outer end row, two air filled hollow adjustably inflatable elongate members, each member extending from one corner coil spring to another corner coil spring between two adjacent convolutions of each of the coil springs along one of said side columns of coil springs and being independently adjustable so as to increase the firmness of one side edge of said spring core relative to the other side edge.

7. A mattress inner spring core having two side edges, said spring core comprising: a plurality of coil springs arranged in a matrix, said matrix having two opposed outer end rows and two opposed outer side columns around the perimeter of said core, each of said coil springs having an upper and lower end turn and a plurality of helical convolutions therebetween; two hollow air filled adjustably inflatable elongated pneumatic members extending along opposed side columns, each pneumatic member being located between two adjacent convolutions of each of said coil springs of one of said side columns and being capable of independently variably adjusting the firmness of one edge of said mattress.

8. The mattress inner spring core of claim 7 wherein said two adjustably inflatable pneumatic members may be filled with differing amounts of air so as to make one side edge of said spring core firmer than the other side edge of said spring core.

9. A method of adjusting the firmness of the edges of a mattress core, which core comprises coil springs located about the periphery of said core, said coil springs each having a central axis, upper and lower end turns and helical convolutions located between said end turns, said coil springs being arranged in a rectangular pattern of at least two opposite end rows and at least two opposite side columns, which method comprises the steps of:

a. placing one adjustably inflatable elongate hollow air filled tube containing substantially no solid material around the perimeter of said mattress between adjacent convolutions of said coil springs; and b. inflating and deflating said tube in order to vary the firmness of the edges of said mattress core.

10. A method of adjusting the firmness of the edges of a mattress core, which core comprises coil springs located about the periphery of said core, each of said coil springs having an upper and lower end turn and helical convolutions located between said upper and lower end turns, said coil springs being arranged in a rectangular pattern with at least two rows, at least one row on either end of said core and at least two columns, at least one column on either side of said core, which method comprises the steps of:

a. placing at least one adjustably inflatable hollow air filled member containing substantially no solid material along the outer side of at least one column of said coil springs and between adjacent convolutions of said column of coil springs;

b. inflating said hollow member with air; and c. modifying the amount of air inside said member in order to vary the firmness of the edge of said mattress core.

11. A method of adjusting the firmness of the edges of a mattress core which core comprises coil springs located about the periphery of said core, each of said coil springs having an upper and lower end turn and helical convolutions located between said upper and lower end turns, said coil springs being arranged in a rectangular pattern with at least two rows, at least one row on either end of said core and at least two columns, at least one column on either side of said core, which method comprises the steps of:

a. placing at least one hollow adjustably inflatable elongate pneumatic member containing substantially no solid material along each side of said mattress between adjacent convolutions of said coil springs; and b. inflating said pneumatic members in order to vary the firmness of one edge of said mattress core relative to the other edge of said mattress core.

* * * * *